US008678612B2

(12) United States Patent
Jasmin, Jr. et al.

(10) Patent No.: US 8,678,612 B2
(45) Date of Patent: Mar. 25, 2014

(54) MODULAR LIGHT SOURCE

(75) Inventors: Roland Jasmin, Jr., Lake Oswego, OR (US); Bonnie A. Larson, Hillsboro, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 758 days.

(21) Appl. No.: 12/423,749

(22) Filed: Apr. 14, 2009

(65) Prior Publication Data

US 2010/0259943 A1 Oct. 14, 2010

(51) Int. Cl.
*F21V 21/00* (2006.01)

(52) U.S. Cl.
USPC ..... 362/217.12; 362/294; 362/249.02

(58) Field of Classification Search
USPC ..... 362/4–6, 96, 227, 249.01–249.03, 362/249.06, 264, 276, 294, 345, 373, 382, 362/512, 547, 580, 642, 800, 388, 217.01, 362/217.02, 217.1, 217.11–217.17, 362/218–225, 249.02, 249.04, 249.05, 362/249.08, 540, 542, 545, 646, 659; 361/707; 165/80.4; 439/116; 340/815.45; 174/250, 252, 260
See application file for complete search history.

(56) References Cited

U.S. PATENT DOCUMENTS 3,870,873 A * 3/1975 Mallory ..... 362/2
4,108,523 A * 8/1978 Bolis ..... 439/116
4,137,424 A * 1/1979 Hesse et al. ..... 174/97
4,385,346 A * 5/1983 Spicer ..... 362/382
4,600,968 A * 7/1986 Sekiya et al. ..... 361/730
4,776,809 A * 10/1988 Hall ..... 439/116
5,473,515 A * 12/1995 Liu ..... 362/466
5,490,048 A * 2/1996 Brassier et al. ..... 362/238
5,576,933 A * 11/1996 Campanella et al. ..... 361/704
5,581,442 A * 12/1996 Morosas ..... 361/704
5,611,393 A * 3/1997 Vasconcelos et al. ..... 165/80.3
5,660,461 A * 8/1997 Ignatius et al. ..... 362/241
5,709,554 A * 1/1998 Savage, Jr. ..... 439/56
5,857,767 A 1/1999 Hochstein
5,936,353 A 8/1999 Triner et al.
6,120,163 A * 9/2000 Graber et al. ..... 362/223
6,170,963 B1 * 1/2001 Arnold ..... 362/246
6,200,134 B1 3/2001 Kovac et al.
6,457,823 B1 10/2002 Cleary et al.

(Continued)

FOREIGN PATENT DOCUMENTS

DE 19619154 A1 6/1997
DE 10127171 A1 12/2001

(Continued)

OTHER PUBLICATIONS

Han® K 4/4 Han Data Sheet 0345 Combined Connector for Power and Signal Harting Electric GmbH & Co. KG | Wilhelm-Harting-Straße 1 | D-32339 Espelkamp, Mar. 27, 2007.

(Continued)

*Primary Examiner* — Hargobind S Sawhney
(74) *Attorney, Agent, or Firm* — Alleman Hall McCoy Russell & Tuttle LLP

(57) ABSTRACT

A light source including a plate and an emitter array mounted on the plate extending from a first edge to a second edge. The plate can include a first edge; a second edge, the first edge being opposite the second edge; a first mount on the first edge; and a second mount on the second edge. Such light sources can be combined together.

13 Claims, 6 Drawing Sheets

(56) References Cited

U.S. PATENT DOCUMENTS

| | | | | |
|---|---|---|---|---|
| 6,501,084 | B1 * | 12/2002 | Sakai et al. | 250/504 R |
| 6,517,221 | B1 * | 2/2003 | Xie | 362/373 |
| 6,683,421 | B1 | 1/2004 | Kennedy et al. | |
| 6,692,250 | B1 | 2/2004 | Decaudin et al. | |
| 7,064,674 | B2 * | 6/2006 | Pederson | 340/815.45 |
| 7,106,592 | B2 * | 9/2006 | Inoue et al. | 361/704 |
| 7,201,511 | B2 * | 4/2007 | Moriyama et al. | 362/646 |
| 7,264,515 | B1 * | 9/2007 | Rubinstein | 439/664 |
| 7,300,187 | B2 * | 11/2007 | Huang et al. | 362/373 |
| 7,338,186 | B1 * | 3/2008 | Wu et al. | 362/294 |
| 7,481,556 | B2 * | 1/2009 | Yarrington | 362/255 |
| 7,513,653 | B1 * | 4/2009 | Liu et al. | 362/294 |
| 7,553,162 | B2 * | 6/2009 | Isoda et al. | 439/56 |
| 7,651,253 | B2 * | 1/2010 | Shuy | 362/547 |
| 7,806,569 | B2 * | 10/2010 | Sanroma et al. | 362/398 |
| 7,810,955 | B2 * | 10/2010 | Stimac et al. | 362/294 |
| 7,950,828 | B2 * | 5/2011 | Zhang et al. | 362/294 |
| 7,950,832 | B2 * | 5/2011 | Tanaka et al. | 362/311.02 |
| 7,963,669 | B2 * | 6/2011 | Hockel et al. | 362/249.02 |
| 8,371,728 | B2 * | 2/2013 | Hente et al. | 362/398 |
| 2001/0024368 | A1 * | 9/2001 | Henrici et al. | 362/249 |
| 2001/0046652 | A1 | 11/2001 | Ostler et al. | |
| 2002/0187454 | A1 | 12/2002 | Melikechi et al. | |
| 2003/0043582 | A1 | 3/2003 | Chan et al. | |
| 2003/0081096 | A1 | 5/2003 | Young | |
| 2004/0120162 | A1 * | 6/2004 | Tsimerman et al. | 362/573 |
| 2004/0246718 | A1 * | 12/2004 | Fan | 362/236 |
| 2005/0083691 | A1 * | 4/2005 | Jahn et al. | 362/249 |
| 2005/0152146 | A1 * | 7/2005 | Owen et al. | 362/294 |
| 2005/0161197 | A1 * | 7/2005 | Rapaich | 165/80.4 |
| 2006/0181878 | A1 * | 8/2006 | Burkholder | 362/294 |
| 2006/0221606 | A1 * | 10/2006 | Dowling | 362/217 |
| 2006/0233501 | A1 | 10/2006 | Sampson | |
| 2006/0274528 | A1 * | 12/2006 | Chou et al. | 362/294 |
| 2007/0064450 | A1 * | 3/2007 | Chiba et al. | 362/655 |
| 2008/0038947 | A1 * | 2/2008 | Wagener | 439/116 |
| 2008/0062694 | A1 * | 3/2008 | Lai et al. | 362/294 |
| 2008/0078524 | A1 * | 4/2008 | Wilcox et al. | 165/11.1 |
| 2008/0244944 | A1 * | 10/2008 | Nall et al. | 40/544 |
| 2009/0086487 | A1 * | 4/2009 | Ruud et al. | 362/249.02 |
| 2009/0147509 | A1 * | 6/2009 | Reed et al. | 362/234 |
| 2009/0267533 | A1 * | 10/2009 | Lee | 315/294 |
| 2010/0128482 | A1 * | 5/2010 | Zhou et al. | 362/253 |
| 2010/0259470 | A1 * | 10/2010 | Kohtoku et al. | 345/102 |

FOREIGN PATENT DOCUMENTS

| | | | | |
|---|---|---|---|---|
| EP | 0 522 185 | A1 * | 7/1991 | H01R 25/14 |
| EP | 0879582 | A1 | 11/1998 | |
| EP | 1158761 | A1 | 11/2001 | |
| EP | 1586810 | A2 * | 10/2005 | |
| WO | 9507731 | A1 | 3/1995 | |
| WO | 0059671 | A1 | 10/2000 | |
| WO | 0067048 | A2 | 11/2000 | |
| WO | 0211640 | A2 | 2/2002 | |
| WO | 0213231 | A2 | 2/2002 | |
| WO | 03023875 | A2 | 3/2003 | |
| WO | WO 2008099305 | A1 * | 8/2008 | |

OTHER PUBLICATIONS

Harting assembly details Terminations Axial screw terminal "Industrial Connectors Han" Issue 02, Chapter 00, p. 14, Mar. 4, 2008.

Data Sheet for G*SiC Technology Super Blue LEDs No. C430-CB290-E1200, manufactured by Opto Semiconductors, May 1, 1999, 8 pages.

Data Sheet for 5.0 mm Blue Series LEDs No. LNG992CFB, manufactured by the Panasonic Corporation, Mar. 2001, 1 page.

Data Sheet for 3.0 mm Blue Series LEDs No. LNG997CKB, manufactured by the Panasonic Corporation, Mar. 2001, 1 page.

Data Sheet for G*SiC Technology Ultraviolet LEDs No. C395-MB290-E0400, manufactured by Cree, Inc., 2 pages.

* cited by examiner

MODULAR LIGHT SOURCE

BACKGROUND

This disclosure relates to light sources and, in particular modular light sources Light sources are used for a variety of applications. For example, light sources can be used to cure inks, coatings, adhesives, or the like. However, in some applications, a size of an illuminated substrate can be greater than a size of an emitter. In such circumstances, multiple emitters can be combined together into a larger composite emitter; however, discontinuities can be present in the arrangement, leading to a non-uniform light output over the surface of the composite emitter. In addition some emitters, such as gas-discharge lamps, are only available in particular lengths. Furthermore, such lamps cannot be combined end-to-end without such discontinuities, described above.

DETAILED DESCRIPTION

Embodiments will be described with reference to the drawings. In particular, in an embodiment, a modular light source where multiple light modules can be combined into a substantially uniform light source.

Figure 1:
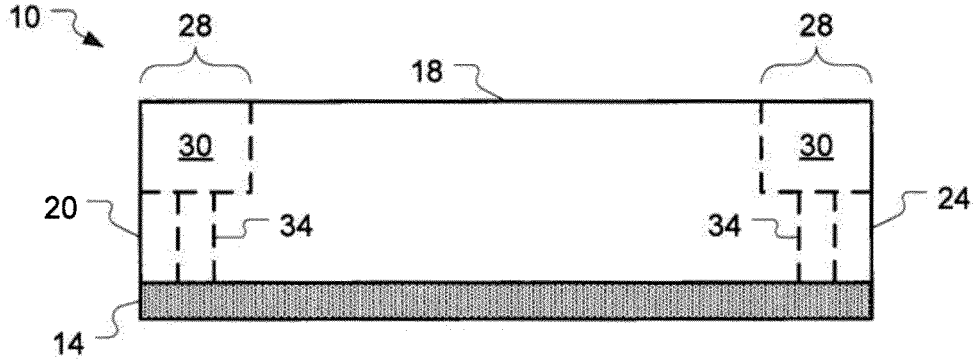
FIG. 1 is a side view of a module according to an embodiment.

FIG. 1 is a side view of a module according to an embodiment. In this embodiment, the module 10 includes an emitter array 14 and a plate 18. The emitter array 14 is mounted on the plate 18. The emitter array 14 extends from a first edge 20 of the plate 18 to a second edge 24 of the plate 18.

In an embodiment, the emitter array 14 is configured to emit light. For example, the emitter array 14 can be an ultraviolet (UV) light emitting diode (LED) array. In another example, the emitter array 14 can be an array of gas discharge lamps. Any array of light emitting elements that can extend to the edges 20 and 24 of the plate 18 can be used.

The plate 18 includes multiple mounts 28. As used herein, a mount 28 is a location, structure, or the like of the plate 18 that can be used to attaching the plate 18 to another structure.

In this embodiment, a mount 28 includes a recessed structure 30 and a threaded hole 34 in the plate 18. Although a particular example has been described, a mount 28 can include other structures, such as detents, tabs, or the like to attach a structure to the mount 28. In addition, a mount 28 need not include a recessed structure 30. As will be described in further detail below, a mount 28 can be used to attach the plate 18 to another structure such as a chassis, another plate 18, or the like.

Figure 2:
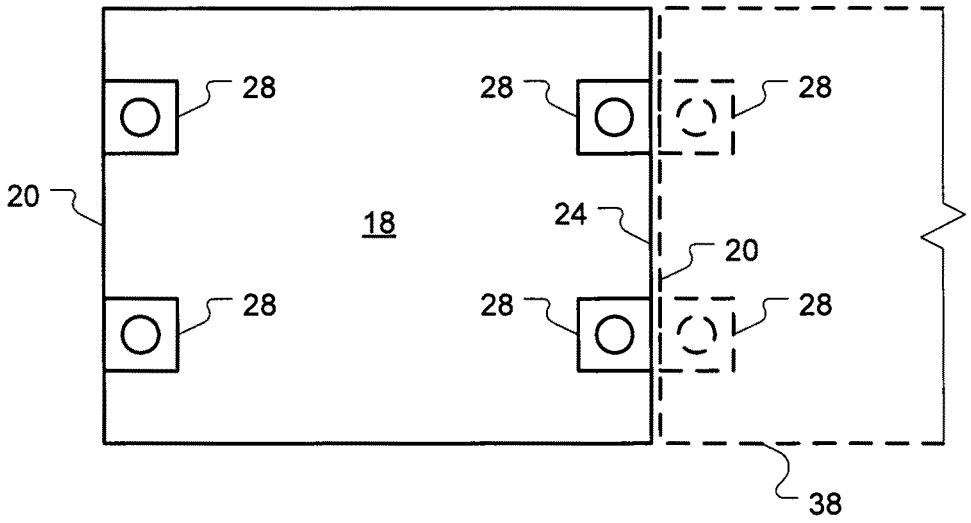
FIG. 2 is a plan view of a plate of the module of FIG. 1.

FIG. 2 is a plan view of a plate of the module of FIG. 1. In this embodiment, the plate 18 has multiple mounts 28 on each of the first edge 20 and the second edge 24. The mounts 28 can be disposed on the edges 20 and 24 such that the mounts 28 align with corresponding other mounts 28. For example, a second plate 38, illustrated in phantom, is disposed adjacent to the plate 18. The mounts 28 of the second side 24 of the plate 18 are aligned with the mounts 28 of the first side 20 of the second plate 38.

In addition, the edges 20 and 24 can be shaped such that the edges can mate with corresponding edges of other plates. For example, the second edge 24 can be shaped such that the second edge 24 can mate with the first edge 20 of the second plate 38. Thus, in an embodiment, the edges of the plates 18 and 38 can be brought together with a minimum amount of offset between the edges. Accordingly, since the emitter array 14 extends to the edges, the emitter arrays 14 attached to the plates 18 and 38 can have a minimum offset between them. Although straight and/or parallel edges have been described, the edges can be curved discontinuous, or the like.

In an embodiment, the first edge 20 and the second edge 24 are substantially parallel. As a result, when edges of two plates are mated, such as the second edge 24 of the first plate 18 and the first edge 20 of the second plate 38, the other edges of the plates can also be substantially parallel. For example, the first edge 20 of the plate 18 can be substantially parallel to the second edge (not shown) of the second plate 38.

Although the mounts 28 have been described as being aligned such that mounts 28 of the first edge 20 and the second edge 24 are aligned. The mounts 28 can be aligned with other mounts, for example, mounts 28 on a first edge 20 of another plate 18. That is, the mounts 28 of first edges 20 of plates 18 can be aligned such that the first edges 20 of the plates 18 can be mated. Similarly, the mounts 28 of the second edge 28 can be aligned with mounts 28 of the second edge 28 of another plate 18. In addition, the mounts 28 can be aligned with mounts 28 on a chassis, as will be described below.

Figure 3:
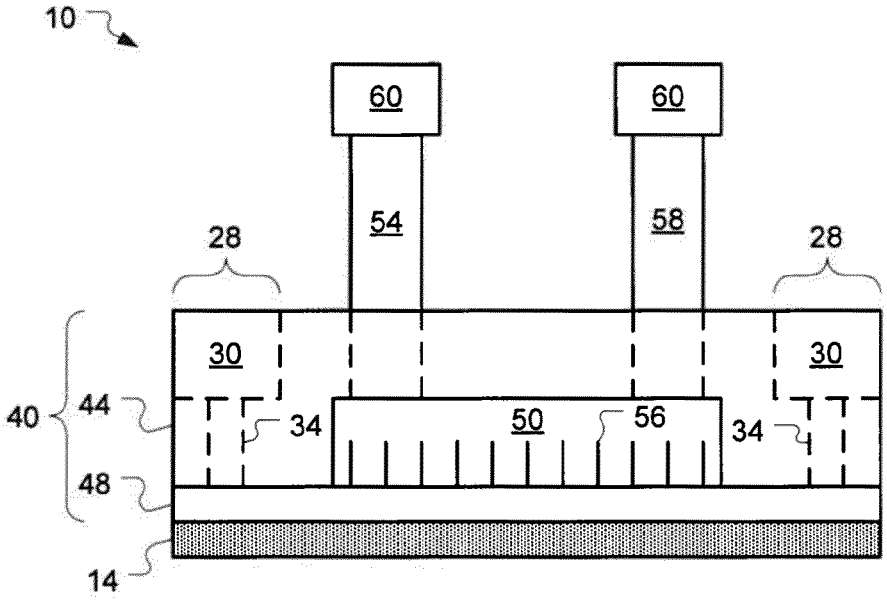
FIG. 3 is a side view of a module according to another embodiment.

FIG. 3 is a side view of a module according to another embodiment. In this embodiment, the plate 40 can include multiple plates. For example, the plate 40 includes an upper plate 44 and a lower plate 48. The upper plate 44 and the lower plate 48 can be formed such that a cavity 50 is formed. Although the cavity 50 is illustrated as within the upper plate 44, the cavity 50 can be formed by a cavity in the upper plate 44, the lower plate 48, or a combination of both. The emitter array 14 can be mounted on the lower plate 48. The mounts 28 can be disposed on the upper plate 44.

In an embodiment, the lower plate 48 can have structures 56, such as protrusions, fins, of the like. Such structures can aid in cooling the emitter array 14. In addition, in another embodiment, passive and/or active cooling can be used with the lower plate 48. For example, forced air can be directed through the lower plate 48, including the structures 56, to cool the emitter array 14. Alternatively, the structures 56 can be used to passively cool the emitter array 14.

In an embodiment, the plate 40 can be a heatsink. The upper plate 44 can be coupled to an inlet tube 54 and an outlet tube 58. The tubes 54 and 58 can allow coolant to pass through the cavity 50. Each of the tubes 54 and 58 can include a valve 60. In am embodiment, the valves 60 can be quick-connect valves. Thus, the valves 60 can be configured to close when not connected. Although the tubes 54 and 58 have been illustrated in a particular arrangement, the tubes 54 and 58 can be disposed on the upper plate 44 as desired.

Figure 4:
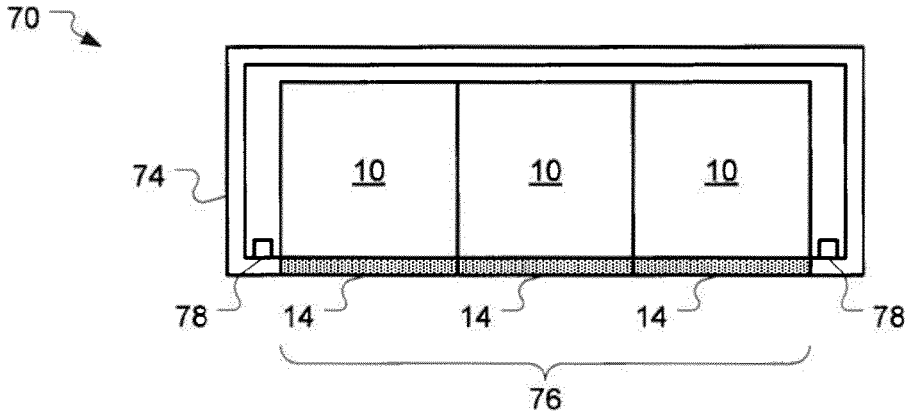
FIG. 4 is a side view of a chassis of a modular light source according to an embodiment.

FIG. 4 is a side view of a chassis of a modular light source according to an embodiment. In this embodiment, the light source 70 includes multiple modules 10. As described above, each module 10 includes a plate 18. The light source 70 can include at least one bracket. Each bracket is mounted on a mount of a corresponding first module of the modules 10 and mounted on the second mount of a corresponding second module of the modules. Thus, the bracket can attach the modules 10 together. In an embodiment, the modules 10 can be attached in a single line, or daisy-chained together. Any number of modules 10 can be combined in such a line.

As described above, the emitter arrays 14 of the modules 10 extend to the first edges to the second edges of the corresponding module 10. As a result, when the plates 18 are attached together, the emitter arrays 14 can create a composite emitter array. That is, as the emitter arrays 14 can be in contact, there can be a negligible gap between the emitter arrays 14, or the like such that the emitter arrays 14 can be considered a single emitter array. Although contact and a negligible gap have been described, an emitter array 14 may not physically extend to and edge of a plate 18; however, individual emitters on the emitter array 14 can be disposed such that a spacing between emitters on the edges of emitter arrays 14 can approach or be equal to a spacing between emitters within an emitter array 14. Thus, the emitters can be spaced across the composite emitter array with substantially the same spacing as within a single emitter array 14.

Figure 5:
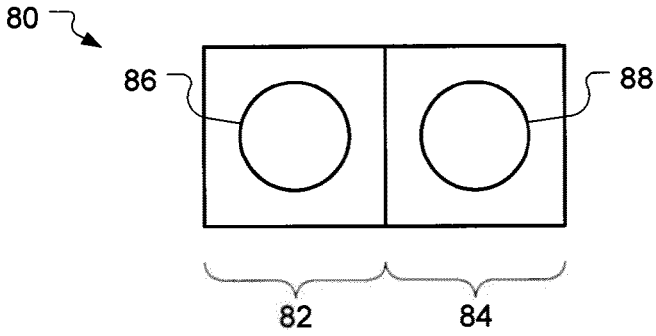
FIG. 5 is a plan view of a bracket of a modular light source according to an embodiment.
Figure 6:
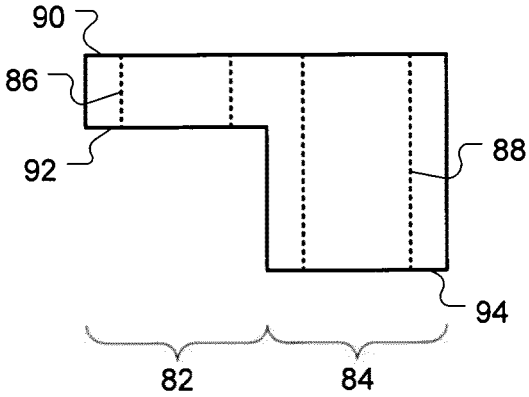
FIG. 6 is a side view of the bracket of FIG. 5.

FIG. 5 is a plan view of a bracket of a modular light source according to an embodiment. FIG. 6 is a side view of the bracket of FIG. 5. Referring to FIGS. 5 and 6, the bracket 80 includes a first portion 82 and a second portion 84. The portions 82 and 84 include a hole 86 and a hole 88, respectively. The bracket 80 includes a first surface 90, a second surface 92, and a third surface 94. Each of the surfaces 90, 92, and 94 can be substantially parallel. However, in an embodiment, the surfaces 90, 92, and 94 can be curved, sloped, discontinuous, or the like to match with a corresponding surface to which the bracket 80 is attached.

In an embodiment, each of the surfaces 90, 92, and 94 is offset from the other surfaces. The first surface 90 extends across the first portion 82 and the second portion 84. The second surface 92 extends across the first portion 82. The third surface 94 extends across the second portion 94. The first surface 90 is on an opposite side of the bracket 80 from the second surface 92 and the third surface 94. Although a particular arrangement of surfaces of a bracket 80 have been described, a bracket 80 can have other configurations. For example, the bracket 80 can be substantially planar. That is, the second surface 92 and the third surface 94 can be substantially coplanar and parallel with the first surface 90. Any configuration can be used appropriate to the configuration of the mounts 28, a chassis, or the like where the brackets will be mounted.

Figure 7:
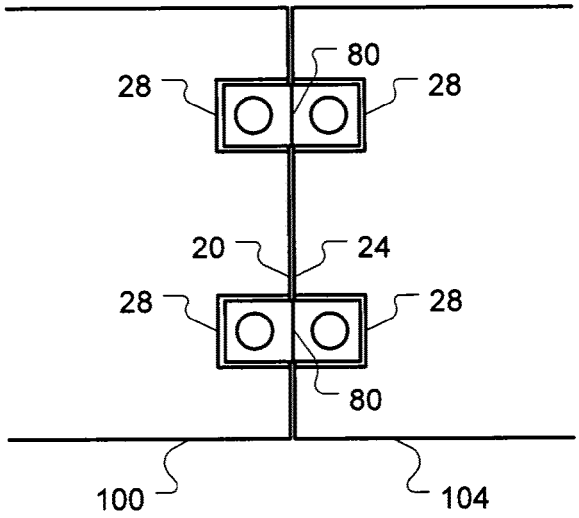
FIG. 7 is a plan view illustrating two adjacent modules coupled together according to an embodiment.

FIG. 7 is a plan view illustrating two adjacent modules coupled together according to an embodiment. The brackets 80 couple plates 100 and 104 of corresponding modules together. The first edge 20 of the first plate 100 is adjacent the second edge 24 of the second plate 104. Mounts 28 of the first plate 100 are adjacent to the mounts 28 of the second plate 104. The brackets 80 are mounted on the mount 28 of the first plate 100 and the second plate 104. Accordingly the plates 104 are attached together.

Although the plates 100 and 104 have been described as adjacent, contacting, or the like, the edges of the plates 100 and 104 can, but need not contribute to mechanical stability of the light source. For example, the plates 100 and 104 can be adjacent, but offset from one another. The brackets 80 can mechanically attach the plates 100 and 104 together. In another example, other structures of the module can be engaged, in contact, or the like. The brackets 80 can secure such engagement, contact, or the like.

Figure 8:
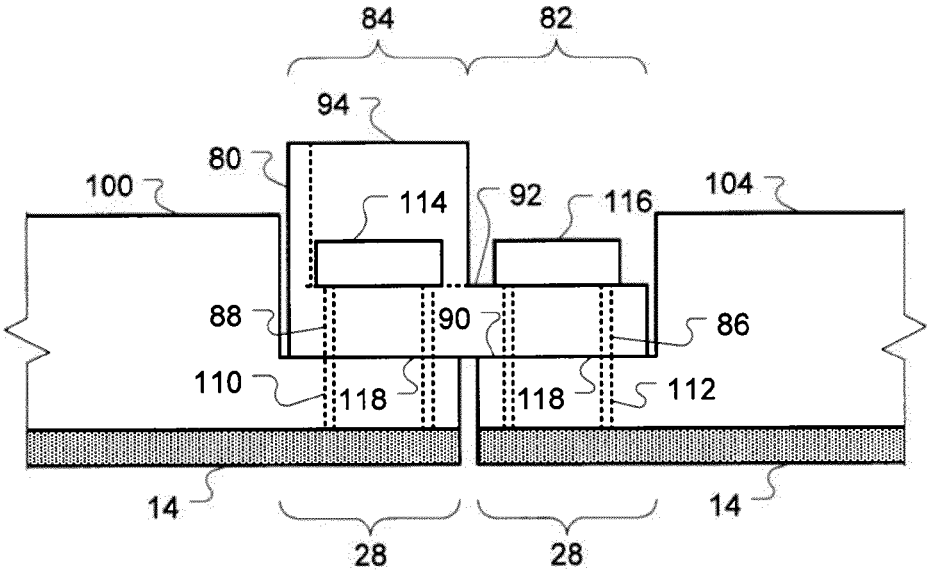
FIG. 8 is a side view of a bracket and mounts of FIG. 7.

FIG. 8 is a side view of a bracket and a mount of FIG. 7. At mounts 28, the plates 100 and 104 have corresponding holes 110 and 112. The holes 110 and 112 can accommodate fasteners 114 and 116 passing through holes 86 and 88 of the bracket 80. The edges of the plates 100 and 104 can be substantially similar in that the mount 28 of each plate 100 and 104 can have a surface 118 that contacts the first surface 90 of the bracket. Although fasteners 114 and 116 have been described as passing through holes 86 and 88, the fasteners can include nuts for attaching to studs placed in the holes 86 and 88, or the like.

In this embodiment, the first surface 90 of the bracket 80 is substantially parallel with each of the surfaces 118 of the plates 100 and 104. Thus, when engaged, the bracket 80 can cause the surfaces 118 of the plates 100 and 104 to be substantially parallel, aligning the plates 100 and 104 together. Thus, the emitter arrays 14 mounted on the plates 100 and 104 can be aligned. Again, although the surfaces 90 and 118 have been described as substantially parallel, the surfaces 90 and 118 can vary as described above according to the shape of the bracket 80 and still achieve alignment of the emitter arrays 14.

In this embodiment, the second surface 92 of the bracket 80 extends into the second portion 84. That is, a recessed area of the second portion 84 of the bracket 80 can be substantially coplanar with the second surface 92 in the first portion 92. As a result, the same or similar fastener can be used for both fasteners 114 and 116.

Referring back to FIG. 4, the light source 70 can include a chassis 74. The chassis 74 can have an opening 76 that exposes the emitter arrays 14 of the modules 10. As described above, the mounts 28 can be used to attach the modules 10 together such that the emitter arrays 14 can form a composite emitter array. In an embodiment, the modules 10 can also be coupled to the chassis 74 using the mounts 28 of the modules 10.

Figure 9:
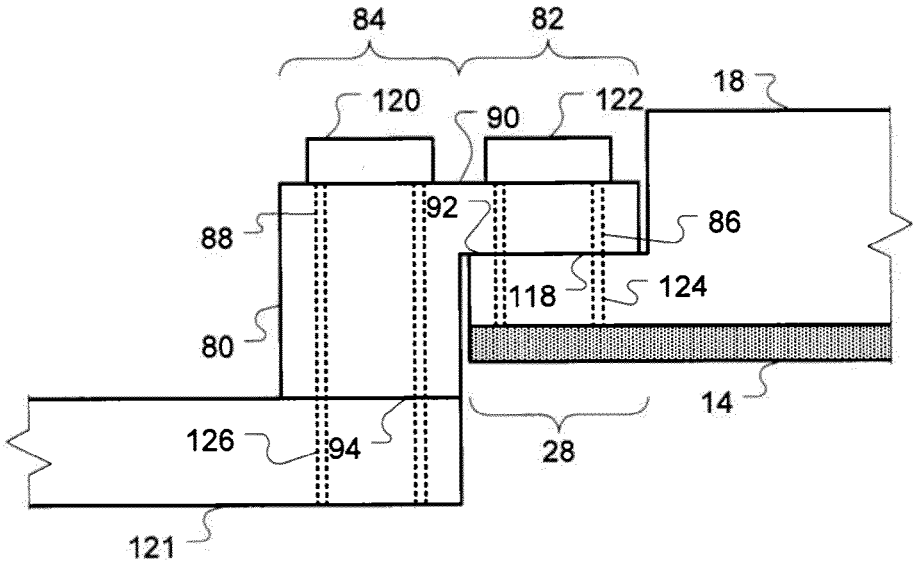
FIG. 9 is a side view of an attachment of a window frame to a module of a modular light source according to an embodiment.

FIG. 9 is a side view of an attachment of a window frame to a module of a modular light source according to an embodiment. In an embodiment, the same bracket 80, described above in attaching modules 10 together, can be used to attach the modules 10 to the window frame 121. As used herein, a window frame 121 is a structure that includes an opening that can reveal the emitter arrays 14.

In this embodiment, the window frame 121 has a hole 126. A fastener 120 can mount the bracket 80 to the window frame 121 through the hole 126. Similarly, a fastener 122 can mount the bracket to a hole 124 in the plate 18. In contrast to the usage of the bracket 80 in FIG. 8, the bracket 80 has been oriented such that different surfaces of the bracket are used for mating to the plate 18 and window frame 121.

In particular, the second surface 92 and the third surface 94 of the bracket 80 are used to mate to the plate 18 and the window frame 121, respectively. As the third surface 94 is offset from the second surface 92, the window frame 121 can be offset from the plate 18 and correspondingly, offset from the modules 10 by using the offset between the second surface 92 and the third surface 94. This offset can be varied as desired; however, since the alignment between plates 18 of the modules 10 can be defined by the first surface 90, a change in the second surface 92 and the third surface 94 need not affect that alignment. Accordingly, a bracket that is substantially similar can be used for both inter-module attachment and module to chassis attachment.

Figure 10:
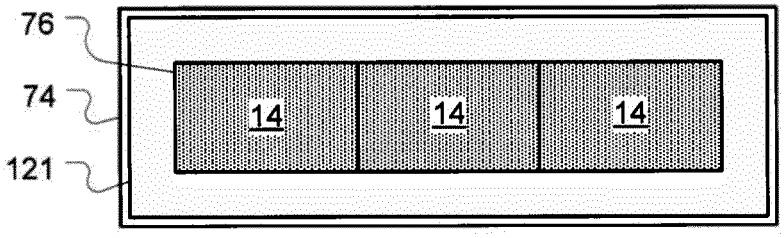
FIG. 10 is a bottom view of the chassis of the modular light source of FIG. 4.

FIG. 10 is a bottom view of the chassis of the modular light source of FIG. 4. When the modules 10 are attached to the window frame 121, as described above, the modules 10 can accordingly be attached to the chassis 74, the emitter arrays 14 are exposed through the opening 76. In an embodiment, the opening 76 can be substantially free of obstructions. That is, although there can be structures dividing the opening 76, the opening can be free of such obstructions such that the composite emitter array formed of the emitter arrays 14 is exposed as whole. Since, as described above, the emitter arrays 14 can substantially abut one another, the opening 76 can effectively expose the entire composite emitter array as if it was a contiguous emitter array. Although the window frame 121, to which the modules 10 can be attached, has been described as separate and detachable from the chassis 74, The chassis 74 and the window frame 121 can form a contiguous structure.

Figure 11:
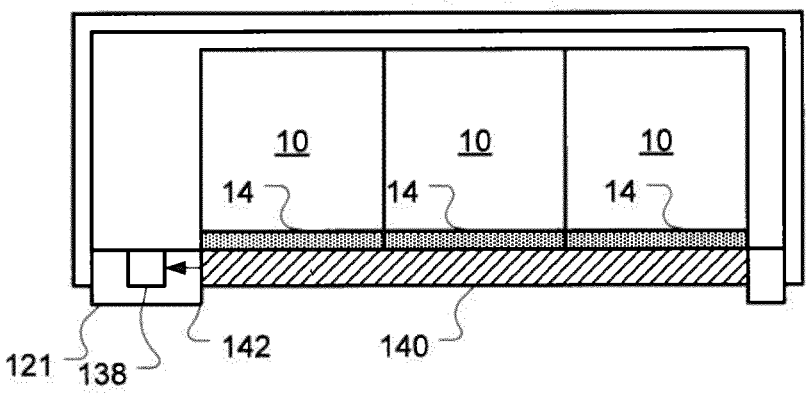
FIG. 11 is a side view of a modular light source according to another embodiment.

FIG. 11 is a side view of a modular light source according to another embodiment. In this embodiment, a window 140 can cover the emitter arrays 14. The window 140 can be mounted in the window frame 121. Accordingly, the window 140 can cover the opening 76 of the chassis 74. The window 140 can be substantially transparent to the emitted light from the emitter arrays 14. For example, the window 140 can be crown glass, borosilicate, crystal, sapphire, or any other type of glass. In another embodiment, the window 140 can be plastic. Accordingly the window 140 can both pass emitted light and protect the emitter arrays 14.

In an embodiment, the light source can include a sensor 138 disposed to sense light emitted from an edge of the window. Although the window 140 has been described above as being substantially transparent, an amount of light can be scattered within the window 140. A portion of that light can be emitted from an edge 142 of the window 140. The sensor 138 can be disposed to sense this light.

As a result, light can be sensed from any or all of the modules 130, 132, and 134. Although the amount of light that reaches the sensor 138 can vary due to the distance of the particular module from the sensor 138, the sensor 138 and/or and processing circuitry can be calibrated such that the variation can be accommodated. For example, if module 130 is activated and emitting light, a sensed value from the sensor 138 can be modified with a first calibration value. If module 134, which is further from the sensor 138 than module 130, is activated and emitting light, a different, second calibration value can be used such that the calibrated sensed amount of light is substantially similar, assuming that the modules 130 and 134 are, in fact, emitting a substantially similar amount of light. Although one sensor 138 has been described, multiple sensors in various locations can be used. In addition, although the sensor 138 has been described as disposed on an edge of the window 140, the sensor 138 can be disposed in other locations where the sensor 138 can receive light emitted by the emitter arrays 14. For example, the sensor 138 can be disposed on the same side of the window 140 as the modules 10. Thus, light that is scattered or reflected off of a surface of the window 140 can be sensed in the sensor 138 and interpreted as described above. In another embodiment, the sensor 138 can be disposed to directly sense the light emitted by the emitter arrays 14.

In addition, in an embodiment, the window 140 can be an optical element such as a plano-convex, plano-concave, Fresnel lens, or the like. That is, the window 140 can focus, collimate, collect, or otherwise manipulate the emissions of the emitter arrays 14.

Figure 12:
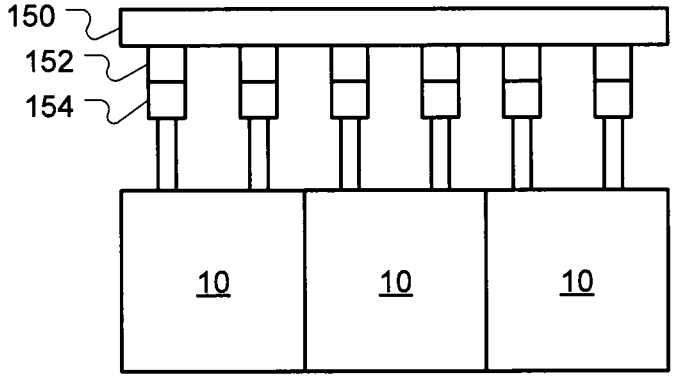
FIG. 12 is a side view of a coolant manifold of a modular light source according to an embodiment.

FIG. 12 is a side view of a coolant manifold of a modular light source according to an embodiment. The emitter arrays 14 can generate heat while emitting light. As described above, the plate 18 can be a heatsink for the corresponding emitter array 14. The heatsink can use coolant to aid in cooling the emitter arrays 14. For example, water, alcohol, compressed air, or the like can be used as coolant.

As described above, a module 10 can have inlet and outlet tubes, each with a valve 154. In an embodiment, the coolant manifold 150 can have a corresponding number of valves 152 according to the number of modules 10. Each of these valves 152 can be disposed on the coolant manifold 150 to mate with the valves 152 and/or tubes of the modules 10.

Each of the valves 152 and 154 can be configured to close when not engaged with another valve or tube. Thus, if the coolant manifold 150 is disconnected from the modules 10, leakage of the coolant can be reduced and/or eliminated. When engaged with the valves 154 of the modules 10, both the valves 152 and 154 can open, allowing both the supply and return of coolant through the manifold 150.

In an embodiment, the valves 152 and 154 can be quick-connect valves. In particular, the valves 152 and 154 can be configured such that the attachment of the coolant manifold 150 can cause the values to open just as the removal can cause the valves to close.

Referring back to FIG. 4, the light source 70 can have sensors 78 configured to sense the presence of coolant. The sensors 78 can be disposed in the chassis 74 in various locations. For example, a first coolant sensor 78 can be disposed at a first end of the chassis 74 while a second coolant sensor 78 can be disposed at a second end of the chassis 74. Thus, if there is a coolant leak, the leaking coolant can be detected. In particular with a sensor 78 disposed at each end, it is more likely that a coolant leak can be detected as the coolant can travel to an end due to gravity and the orientation of the light source 74. However, although multiple coolant sensors 78 have been described, a single sensor 78 can be used.

Figure 13:
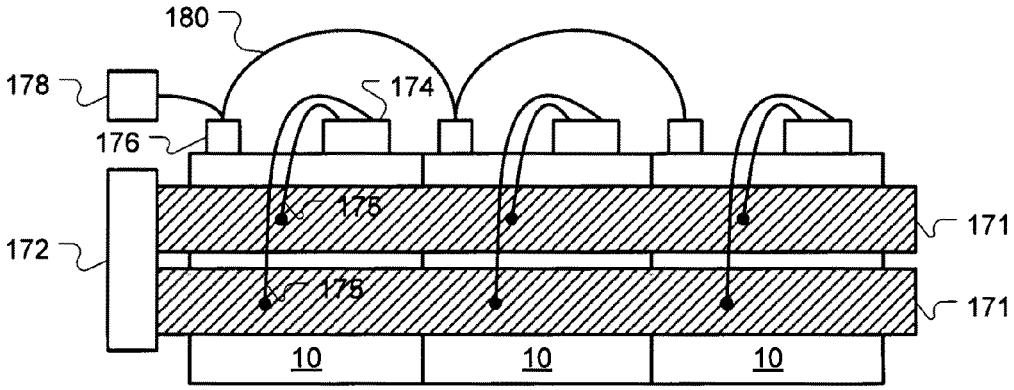
FIG. 13 is a side view of a modular light source according to another embodiment.

FIG. 13 is a side view of a modular light source according to another embodiment. In this embodiment, the light source 170 can include multiple conductors 170. The conductors 171 can extend along the length of the light source 170. The conductors 171 can be configured to supply power to the modules 10. For example, each of the conductors 171 can be a busbar, such as a length of copper or other metal with a rectangular cross-section. The conductors 171 can be appropriately sized to accommodate the power supplied to the light source 170. For example, each module 10 can use multiple kilowatts of power.

In addition to supplying power, the conductors 171 can also provide mechanical support for the light source. For example, as the conductors 171 can be relatively thick, the conductors 171 can provide a degree of rigidity to the light source 170.

The conductors 171 can be coupled to at least one connector 172. For example, one connector 172 is illustrated as coupled to the two conductors 171. Each conductor 171 can be coupled to different contacts of the connector 172. However, in another embodiment, each conductor 172 can have one or more corresponding connectors 172.

Each module 10 can include a connector 174. The connector 174 can be configured to receive power for the module from the conductors 171. For example, wires 175 can connect he connector 174 to the conductors 171. As a result, in addition to receiving power, each module 10 can be individually disconnected from the conductors 171. Thus, a given module 10 can be removed without affecting the connections of the other modules. In particular, the conductors 171 can be disposed to be on a side of the light source 170 such that the conductors 171 do not interfere with removal of a particular module 10.

In addition to power supply connections, each module 10 can include a connector 176 for communication with the module 10, control of the module 10, or the like. In an embodiment, the connectors 176 can be coupled to a cable 180. For example, the contacts of the connectors 176 can be connected in common with contacts of connectors 176 of other modules 10 to conductors of the cable 180. The cable 180 can be coupled to a connector 178. The connector 178 can allow for interface to the modules 10 through the cable 180 and associated connectors 176. Accordingly, although multiple modules 10 can have independent power supplies, control interfaces, or the like, the power, control or the like can be presented to a user of the light source 170 such that the light source 170 appears as a single light source.

Figure 14:
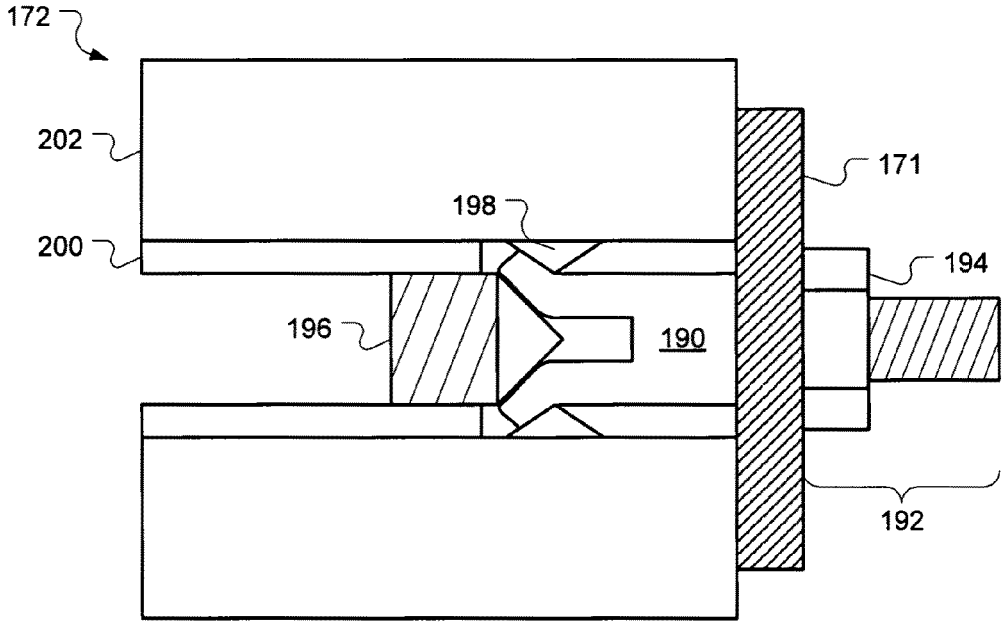
FIG. 14 is a side view of a contact of a connector of FIG. 13.

FIG. 14 is a side view of a contact of a connector of FIG. 13. In an embodiment, a contact 190 of a connector 172 can have a threaded section 192. The threaded section 192 can be used to engage the contact 190 and a conductor 172. For example, a nut 194 can engage the contact 190 and the conductor 171.

In this embodiment, the connector 172 includes a set screw 196 configured to make electrical contact with the contact 190. In particular the set screw 196 can cause the end of the contact 190 to engage with the mechanical stops 198, thus securing the contact 190 within the connector 172. The connector 172 can include a connector conductor 200 attached to the housing 202. The set screw 196 can be threaded into the connector conductor 200 to secure the contact 190 to the connector 172. Accordingly, a cable need not be used to make an electrical connection between the connector conductor 200 and the busbar 171.

As there can be multiple contacts 190, there can be multiple connections with a conductor 171. Thus, the current supplied to the conductor 171 can be distributed among the multiple contacts 190.

As used herein a fastener can be any type of structure that can secure two structures together. For example, a fastener can include a screw, a brad, a pin, a nail, a bolt, a nut, or the like. Moreover, various different types of fasteners can be used within one light source, for example, in connecting a bracket to a module and a chassis.

Although particular embodiments have been described, it will be appreciated that the principles of the invention are not limited to those embodiments. Variations and modifications may be made without departing from the principles of the invention as set forth in the following claims.

The invention claimed is:

1. A light source, comprising:

a plurality of modules, each module including:

a plate including:

a first edge;

a second edge, the first edge being opposite the second edge;

a first mount on the first edge; and a second mount on the second edge;

a communication connector;

a power connector; and an emitter array mounted on the plate extending from the first edge to the second edge;

conductors extending a length on a side of the light source, the conductors arranged to connect to the power connector on each module, each module removable without affecting other connections to other modules; and a coolant manifold including a plurality of valves; wherein each module includes a plurality of valves and a plurality of tubes, each valve coupled to the plate through a corresponding tube; and each valve of the valves of the modules is coupled to a corresponding valve of the valves of the coolant manifold.

2. The light source of claim 1, wherein each of the valves of the coolant manifold and the modules is a quick-connect valve.

3. The light source of claim 1, further comprising:

a chassis having an opening;

wherein the modules are disposed in the chassis such that for each module, the emitter array is exposed by the opening of the chassis.

4. The light source of claim 3, further comprising:

a first coolant sensor disposed at a first end of the chassis; and a second coolant sensor disposed at a second end of the chassis.

5. The light source of claim 3, further comprising a substantially transparent window covering the opening.

6. The light source of claim 5, further comprising a sensor disposed to sense light emitted from an edge of the window.

7. The light source of claim 1, wherein the conductors comprise busbars extending along a length of the light source.

8. The light source of claim 1, wherein the connectors include a plurality of contacts, each contact including a threaded section;

wherein:

each contact of the power connector is coupled to a corresponding conductor coupled to the modules by a nut engaged with the threaded section.

9. The light source of claim 1, wherein the module includes at least one bracket, wherein each bracket comprises:

a first surface;

a second surface substantially parallel to the first surface; and a third surface substantially parallel to the first surface.

10. The light source of claim 9, wherein for a first module and a second module of the plurality of modules:

the first edge of the first module is adjacent the second edge of the second module;

the first mount of the first module is adjacent to the second mount of the second module;

a bracket of the at least one bracket is mounted on the first mount of the first module and the second mount of the second module.

11. The light source of claim 1, wherein the module includes at least one bracket, the light source further comprising:

a chassis;

wherein:

the at least one bracket includes a plurality of brackets;

a bracket of the plurality of brackets is mounted to a first mount of one of the modules and the chassis.

12. The light source of claim 11, wherein each of the plurality of brackets is substantially similar.

13. The light source of claim 1, further comprising a cable including a connector for each connector of the modules.

* * * * *